United States Patent [19]

Hall

[11] 4,081,987

[45] Apr. 4, 1978

[54] CURLING PUNCH

[75] Inventor: Larry Baker Hall, Smyrna, Ga.

[73] Assignee: Lockheed Corporation, Burbank, Calif.

[21] Appl. No.: 786,459

[22] Filed: Apr. 11, 1977

[51] Int. Cl.[2] ..... B21D 5/01

[52] U.S. Cl. ..... 72/389; 72/413; 72/462; 72/470

[58] Field of Search ..... 72/389, 385, 386, 380, 72/412, 413, 470, 473, 462

[56] References Cited

U.S. PATENT DOCUMENTS

| | | | |
|---|---|---|---|
| 1,535,295 | 4/1925 | Connery | 72/413 |
| 2,293,184 | 8/1941 | Weissert | 72/389 |
| 3,142,174 | 7/1964 | Baker | 72/389 |
| 3,209,576 | 10/1965 | Giordano | 72/389 |
| 3,757,559 | 9/1973 | Welsh | 72/389 |

*Primary Examiner*—C.W. Lanham
*Assistant Examiner*—Gene P. Crosby
*Attorney, Agent, or Firm*—Billy G. Corber; Albert L. Carter

[57] ABSTRACT

A power brake punch for curl forming radii of greater than 180° of arc on the edge of sheet metal workpieces.

5 Claims, 4 Drawing Figures

CURLING PUNCH

This invention relates to power brake or punch machine tooling, and more specifically to a punch member adapted to permit power forming of radii in the edge portions of sheet metal workpieces in arcuate excess of 180°.

Prior art tooling devices for punch forming radii along longitudinal edges of sheet metal workpieces have consisted of punch and die members of fixed configuration. In the case of forming radii of greater than 180° in arcuate length, the degree of arcuate length was limited by the amount of offset that could be built or designed into the punch member between the center of the punch nose and the main body thereof. In no event could the arcuate length be greater than 360° less the arcuate amount of the thickness of the punch member portion intermediate the nose and the main body portion of the punch member. Even then, this rarely exceeded much beyond 180° of arcuate length without the necessity of hand forming for completion.

By use of this invention it has been found that the heretofore known limits of arcuate length in radii along sheet metal member edges have been overcome and that radii arcuate extensions of up to substantially 360° may be accomplished in an easy, cheap and facile manner.

Accordingly, it is an object of this invention to provide a curling punch for forming a sheet metal edge radii of up to 360° arc.

Another object of this invention is to provide tooling to form such sheet metal edge radii in a quick, easy and inexpensive manner.

A further object of this invention is to provide a relatively inexpensive curling punch tooling for forming sheet metal edge radii of up to 360° in arcuate length.

Further objects and advantages of this invention will become apparent from the following description taken into connection with the accompanying drawings in which.

Generally stated the invention comprises a curl forming punch assembly consisting of a bifurcated main body member with an aligned passage or hole in each tang through which extends a punch forming rod and bridges the gap or space between the tangs. By repetitive power forcing of the punch rod into the channel of a die member with a sheet metal workpiece located therebetween, the sheet metal workpiece is deformed around the punch rod in such a manner that upon continuous deformation operations and appropriate relocation of the workpiece relative to the punch and die tools, a curl or radii is formed along the edge of the workpiece of whatever degree of arcuate length desired; the inside diameter of the curvature or radius being equivalent to the outer diameter of the punch rod.

Figure 1:
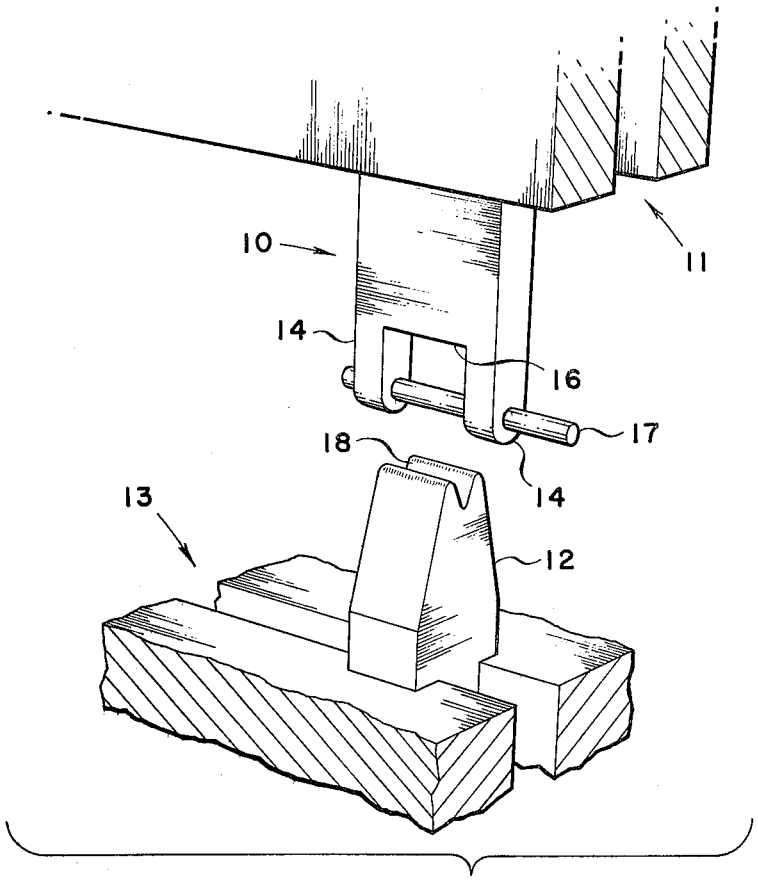
FIG. 1 shows a partial, perspective view of one embodiment of a punch die set of this invention mounted in a power brake machine.
Figure 2:
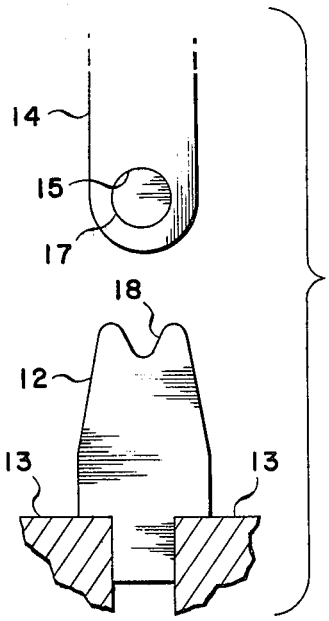
FIG. 2 is a side view of the punch and die numbers of FIG. 1 and their relationship when mounted respectively in a machine tool ram and bed.
Figure 3:
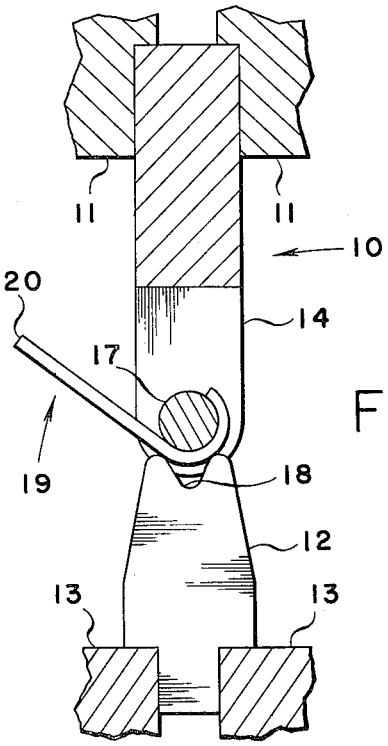
FIG. 3 shows the interaction and relationship of the punch and die members after the formation of a partial arcuate segment along the edge of a workpiece.

More specifically, referring to FIGS. 1 through 3 of the drawings, a punch body member 10 is shown appropriately clamped to a movable ram assembly 11 of a power brake or other machine tool means. Likewise, a die member 12 is shown clamped by a bed assembly 13 of the machine tool.

Body member 10 is bifurcated to form a pair of tangs 14, each of which has a hole 15 therein arranged such that the holes 15 of both tang members 14 are in axial alignment. The tang members 14 are arranged so as to provide a space or cutout 16 therebetween which is greater than the length of die 12 for a purpose to be explained in more detail hereinafter. A punch forming rod 17 extends through both holes 15 in tangs 14 and extends across the cutout 16 between the tangs 14.

Die 12 contains an angular cutout or groove 18 that is longitudinally coaxial with forming rod 17 and in confrontation therewith. The width of the angular cutout or groove 18 is such that as the machine ram assembly 11 moves the rod 17 downwardly toward die 12 with a workpiece member 19 extending between the rod 17 and die 12, as the rod 17 is sufficiently close to groove 18 a portion of the workpiece 19 is curled around rod 17 as best seen in FIG. 3. As each subsequent forming operation takes place, the edge portion of workpiece 19 sequentially attains a greater degree of curl arcuate length with the curled portion advancing around the outer diameter of rod 17 as the machine operator continues advancement feeding of workpiece 19 by an appropriate downward movement of the end portion 20 of workpiece 19 as the curled end of workpiece 19 moves around rod 17 into the cutout 16.

As can readily be seen and understood, once the curled edge of workpiece 19 exceeds an arcuate length of greater than 180° around rod 17, removal of the workpiece from 17 is accomplished by the longitudinal sliding or removal of rod 17 from holes 15 as well as the curled end portion of workpiece 19. Also, it can be readily seen and understood that the radius of the end curl of workpiece 19 is controlled or defined by the outer diameter of rod 17 that extends across the cutout 16. Furthermore, since the lower surface of tangs 14 are below the upper surfaces of die 12 when the punch 10 and die 12 members are in a workpiece forming position as best seen in FIGS. 3, the longitudinal length of die 12 cannot exceed the longitudinal width of cutout 16 and is preferably sufficiently less to allow whatever amount of clearance desired.

Figure 4:
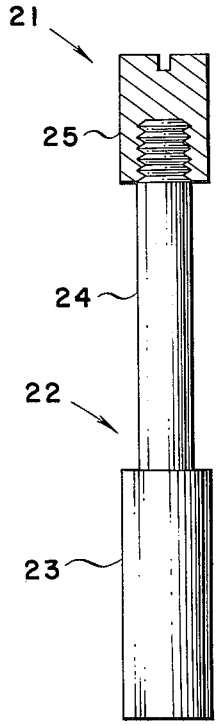
FIG. 4 shows another embodiment of one element of the punch member shown in FIGS. 1 through 3.

In FIG. 4 there is shown a second embodiment of this invention which permits the use of the same body member 10 for a plurality of curl diameters whereby a smaller curl diameter may be accomplished with a two piece forming rod 21 comprising a first shaft member 22 having a large diameter portion 23 and a small diameter portion 24. A nut or bushing member 25 is engageable with the end of the smaller diameter rod portion 24 at the end opposite the larger diameter portion 23 by a sliding or threaded connection. The outer diameters of shaft portion 23 and nut or bushing 25 is such that they will fit into the holes 15 in the tangs 14 of body member 10 with the smaller diameter shaft portion 24 being of a length to bridge the cutout 16. In this manner, a smaller diameter end curl of the workpiece 19 may be formed if operation in the same manner as diameter forming rod 17 is utilized. The slide or threaded connection between shaft portions 24 and nut or bushing 25 is necessitated to permit withdrawal of the shaft portion 24 from a workpiece 19 having an edge curl of greater than 180°.

While particular embodiments of the invention have been illustrated and described, it will be obvious to those skilled in the art that various changes and modifications may be made without departure from the invention and it is intended to cover in the appended claims all such modifications and equivalents as fall within the true spirit and scope of this invention.

I claim:

1. A machine tool punch assembly for edge curling of sheet metal workpieces comprising:

a body member means adapted to depend from a machine tool ram when mounted therein to present a body edge distal from the ram;

said distal edge of the body means having an intermediate cutout to form a pair of spaced apart tang projections;

a passage extending through each tang projection, said passages located so as to be in coaxial alignment;

and a removable rod means extending through both tang passages and across the cutout between the tang projections.

2. A machine tool punch assembly as claimed in claim 1 wherein said rod means is of constant diameter throughout its length.

3. A machine tool punch assembly as claimed in claim 1 wherein said rod means comprises a shaft member having at least two diameters, the larger of the diameters slidably fitting the passage in one tang projection; and a bushing means having an outer diameter slidably fitting the passage in the other tang projection and an inner passage fitting the smallest diameter of said shaft member.

4. A machine tool punch assembly as claimed in claim 3 wherein the fitting between the bushing means and the smallest diameter of the shaft member is a slideable engagement.

5. A machine tool punch assembly as claimed in claim 3 wherein the fitting between the bushing means and the smallest diameter of the shaft members is a threaded engagement.

* * * * *